United States Patent [19]

Rudoy et al.

[11] Patent Number: 5,035,632

[45] **Date of Patent: * Jul. 30, 1991**

[54] CARD CONNECTOR WITH INTERCEPTOR PLATE

[75] Inventors: Edward Rudoy, Woodland Hills; Michael A. Lin, Anaheim, both of Calif.

[73] Assignee: ITT Corporation, New York, N.Y.

[ * ] Notice: The portion of the term of this patent subsequent to Aug. 21, 2007 has been disclaimed.

[21] Appl. No.: 525,936

[22] Filed: May 18, 1990

Related U.S. Application Data

[63] Continuation-in-part of Ser. No. 419,405, Oct. 10, 1989, Pat. No. 4,950,172.

[51] Int. Cl.[5] ..... H01R 13/648

[52] U.S. Cl. ..... 439/108; 439/62; 439/607

[58] Field of Search ..... 439/92, 108, 607, 69, 439/741, 743, 59, 62, 65

[56] References Cited

U.S. PATENT DOCUMENTS

| | | | |
|---|---|---|---|
| 4,070,084 | 1/1978 | Hutchison | 339/143 |
| 4,148,543 | 4/1979 | Shores | 339/143 |
| 4,226,496 | 10/1980 | Langham | 439/637 |
| 4,232,929 | 11/1980 | Zobawa | 339/143 |
| 4,386,814 | 6/1983 | Asick | 339/14 |
| 4,407,552 | 10/1983 | Watanabe et al. | 339/143 |
| 4,418,972 | 12/1983 | Benasutti | 439/607 |
| 4,511,196 | 4/1985 | Schuler et al. | 339/14 |
| 4,550,960 | 11/1985 | Asick et al. | 339/14 |
| 4,552,420 | 11/1985 | Eigenbrode | 330/14 |
| 4,571,014 | 2/1986 | Robin et al. | 339/14 |
| 4,601,527 | 7/1986 | Lemke | 339/14 |
| 4,616,893 | 10/1986 | Feldman | 339/14 |
| 4,619,494 | 10/1986 | Noorily et al. | 339/103 |
| 4,632,476 | 12/1986 | Schell | 339/14 |
| 4,634,199 | 1/1987 | Anhalt et al. | 439/69 |
| 4,641,901 | 2/1987 | Brennan et al. | 339/14 |
| 4,653,837 | 3/1987 | Phillipson et al. | 339/143 |
| 4,653,840 | 3/1987 | Grabbe et al. | 339/177 |
| 4,655,515 | 4/1987 | Hamsher, Jr. et al. | 339/14 |
| 4,687,267 | 8/1987 | Header et al. | 439/62 |
| 4,695,106 | 9/1987 | Feldman et al. | 439/83 |
| 4,708,412 | 11/1987 | Himes, Jr. et al. | 43/95 |
| 4,726,638 | 2/1988 | Farrar et al. | 439/620 |
| 4,731,031 | 3/1988 | Lemke | 439/96 |
| 4,743,080 | 5/1988 | Siraty | 439/492 |
| 4,747,787 | 5/1988 | Siwinski | 439/108 |
| 4,752,231 | 6/1988 | Olsson | 439/66 |
| 4,761,147 | 8/1988 | Gauthier | 439/607 |
| 4,773,878 | 9/1988 | Hansell, III | 439/92 |
| 4,789,358 | 12/1988 | Zell et al. | 439/607 |
| 4,806,109 | 2/1989 | Manabe et al. | 439/108 |
| 4,806,110 | 2/1989 | Lindeman | 439/108 |
| 4,869,672 | 9/1989 | Andrews, Jr. | 439/60 |
| 4,872,851 | 10/1989 | Babuka et al. | 439/635 |
| 4,908,335 | 3/1990 | Cosmos et al. | 439/609 |

*Primary Examiner*—Gary F. Paumen

[57] ABSTRACT

A connector is provided of the type that has rows of contacts, which minimizes cross talk between adjacent contacts. An interceptor plate (60, FIG. 2) which is grounded or at another controlled potential, extends along each row of contacts (34), the plate lying close to the row to provide better capacitive coupling between each contact and the plate than between contacts of the same or different rows.

12 Claims, 6 Drawing Sheets

FIG. 4
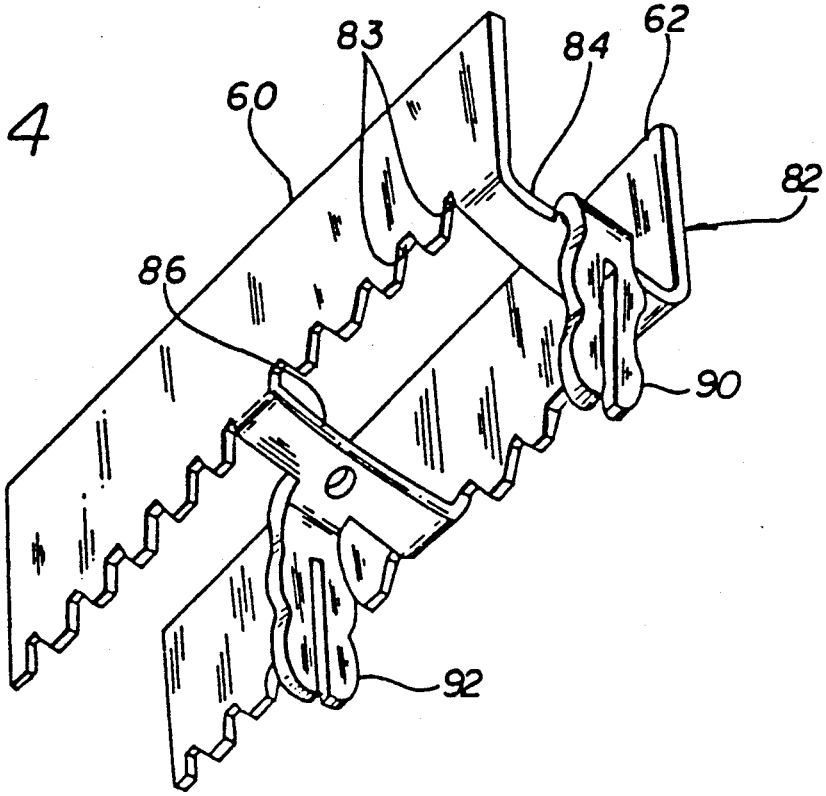
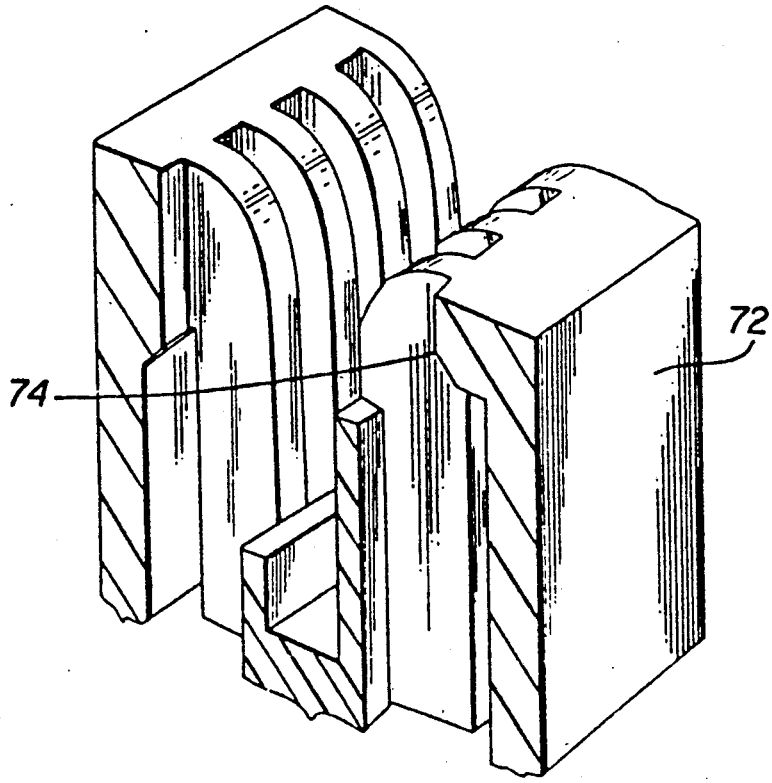
FIG. 5

CARD CONNECTOR WITH INTERCEPTOR PLATE

CROSS REFERENCE TO RELATED APPLICATION

This is a continuation-in-part of U.S. Pat. application Ser. No. 07/419,405 filed Oct. 10, 1989, now U.S. Pat. No. 4,950,172.

BACKGROUND OF THE INVENTION

As clock speeds of electrical systems increase, attention has to be paid to connectors that connect circuit boards to one another or to other peripherals, in order to prevent signal degradation at the connectors. Cross talk between adjacent contacts can be a problem. Connectors often include two parallel rows of contacts. One prior art approach is to embed a grounded plate halfway between two rows of contacts in insulation lying between the contacts. Such a grounded plate reduces cross talk, but not sufficiently for high speed circuits. A connector which greatly reduced cross talk between contacts as well as outside interference would be of considerable value.

SUMMARY OF THE INVENTION

In accordance with one embodiment of the present invention, a connector with row of contacts is constructed to greatly isolate the contacts from one another to prevent cross talk between adjacent contacts as well as to avoid outside interference. Each contact has a mounted part held on an insulative mount and an elongated leg, the legs of a row of contacts have portions that lie substantially coplanar, and an interception plate is provided near the leg portions to minimize cross talk. The interception plate, which is maintained at a controlled constant or periodically varying potential, extends along a plane that is close to and parallel to the plane of the contact leg portions. With two rows of contacts, two interception plates are provided that lie outside the space between the two rows of contacts. Each interceptor plate is close enough to a contact leg, and preferably to a face of a strip-shaped contact leg, so there is a large area of the contact leg facing the plate, and there is much better capacitive coupling between the plate and each contact than between adjacent contacts.

The novel features of the invention are set forth with particularity in the appended claims. The invention will be best understood from the following description when read in conjunction with the accompanying drawings.

BRIEF DESCRIPTION OF THE DRAWINGS

FIG. 4 is a bottom isometric view of an interceptor of the connector of FIG. 1.

FIG. 5 is a partial isometric view of the housing insulator of FIG. 2.

DESCRIPTION OF THE PREFERRED EMBODIMENTS

Figure 1:
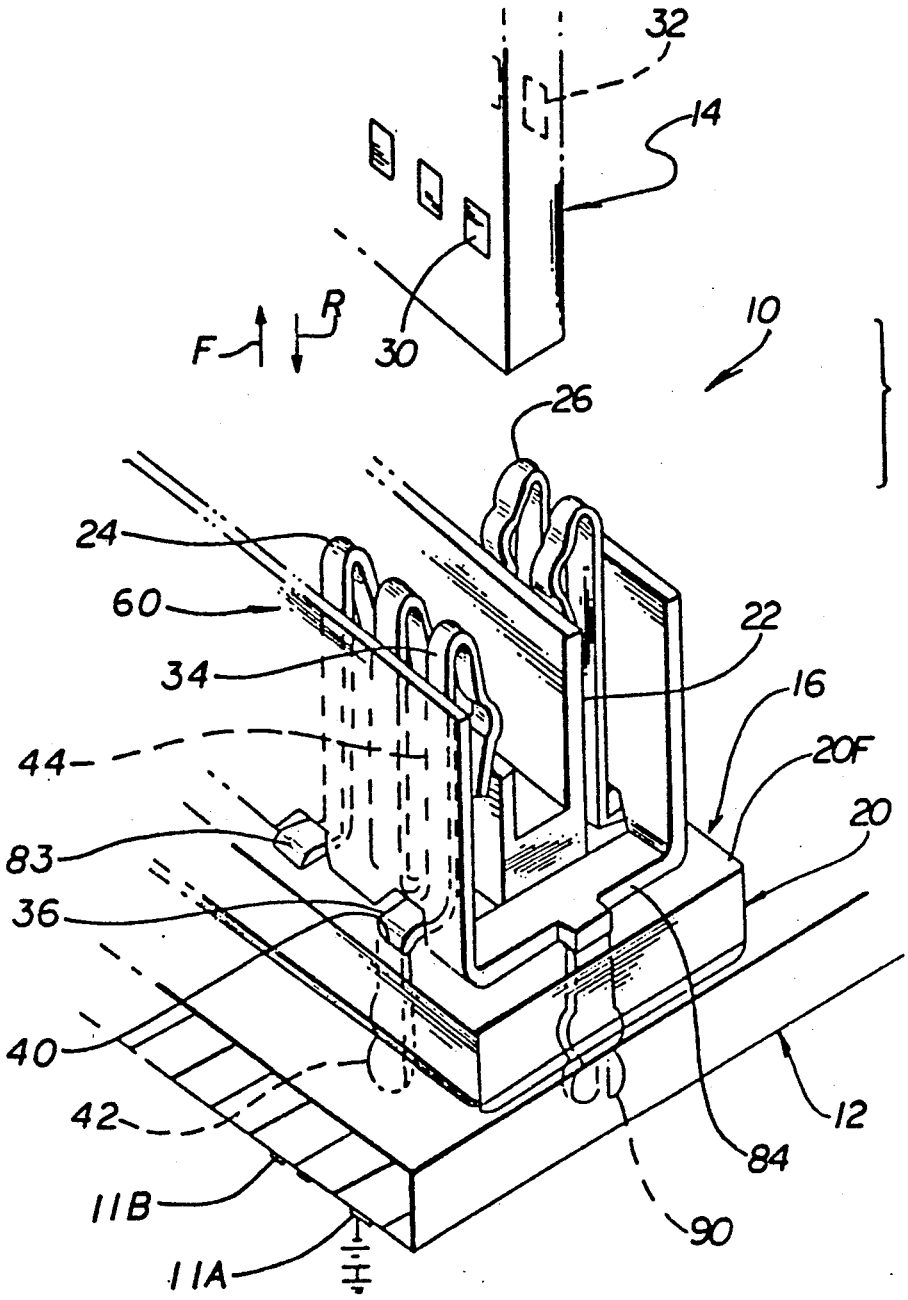
FIG. 1 is a partial isometric view of a connector of one embodiment of the invention, shown without the insulation in place, and showing how it is used with two perpendicular circuit boards.
Figure 3:
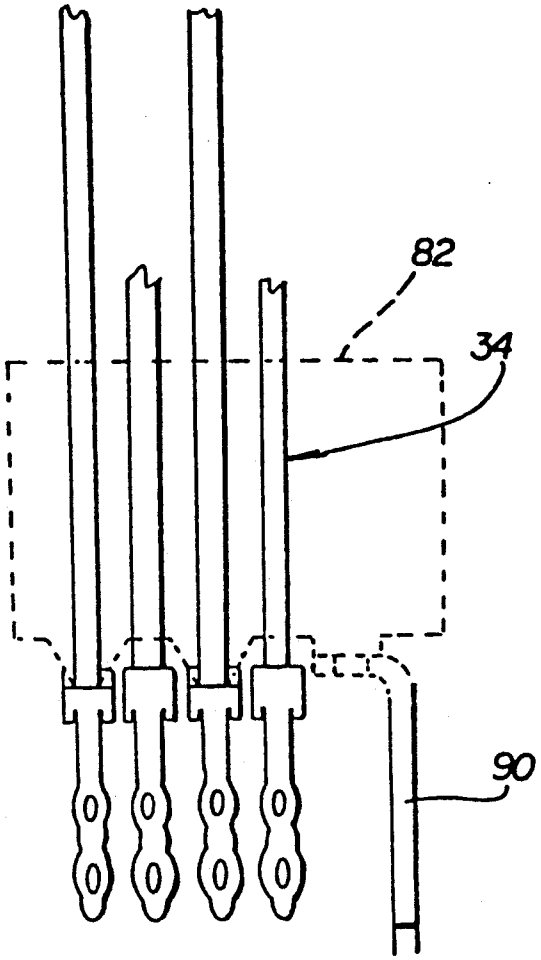
FIG. 3 is a partial side elevation view of the connector of FIG. 1.

FIG. 1 illustrates a connector 10 which is used to connect conductors such as 11A, 11B on first and second circuit boards 12, 14. The connector has a housing 16 that includes a support 20 held on the first circuit board 12. The housing also includes a board or card end receiver 22 that is held on the support and that receives the second circuit board 14 to a final position against a rear face of the receiver. The connector includes first and second rows of contacts 24, 26 for contacting rows of conductive pads 30, 32 on the second circuit board.

Figure 2:
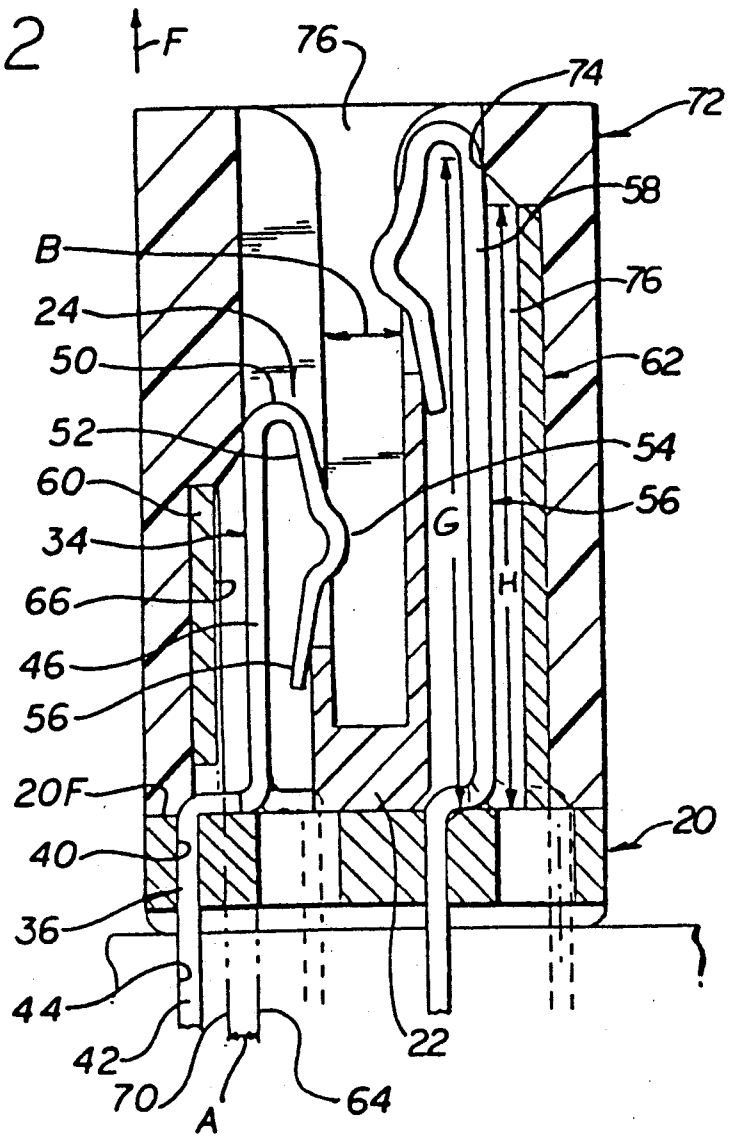
FIG. 2 is a sectional view of the connector of FIG. 1, but with the housing insulator in place.

As shown in FIG. 2, each contact such as 34 includes a mounted part 36 that extends along the front face 20*f* of the support 20 and closely through a hole 40 in the support. In this system, the mount part has a rearward end 42 that is electrically connected and fixed to a plated-through hole 44 in the first circuit board. Each contact also has an elongated leg 46 that extends forwardly, in the direction of arrow F, from the mounted part 36. The contact has a substantially 180° loop 50 at the forward end of the leg, and has a reverse arm 52 extending largely rearwardly from the loop, the reverse arm having a protrusion 54 for contacting a pad on the second circuit board. The reverse arm also has a rearward end 56 that bears against a side of the receiver 22. Each contact such as 56 of the second row is similar, except that its leg 58 is longer.

In accordance with the present invention, the connector includes a pair of interception plates 60, 62 that minimize cross talk between each contact and adjacent contacts of the same or other row. The elongated legs such as 46 of the contacts in a row such as 24 all lie substantially in a common imaginary plane 64. The contacts such as 34 are formed from strips of metal having a greater width than thickness, and the plane 64 lies at the faces of the contact legs that are closest to the interception plate 60. The plate 60 has an inner face 66 that lies in an imaginary plane 70 that is parallel to the plane 64 of the contact legs. The distance A between adjacent faces of the contact legs and interception plate is small, so there can be close capacitive coupling of the interception plate with the contact leg of each contact of a row of contacts.

Figure 6:
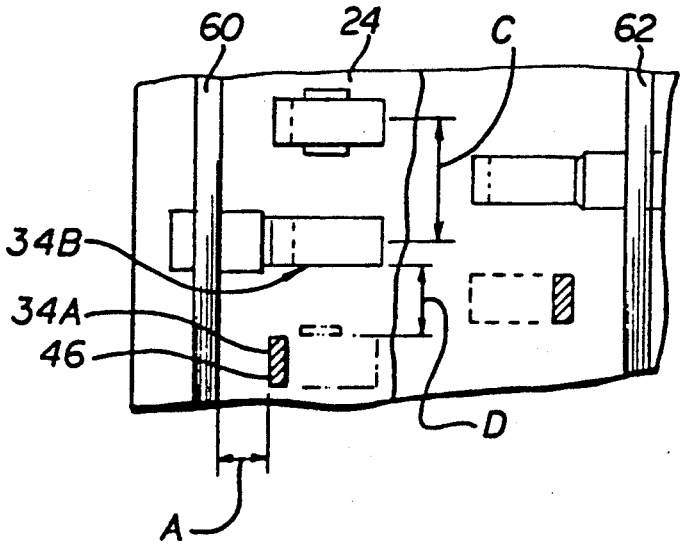
FIG. 6 is a partial plan view of the connector of FIG. 1.

The distance A between the interceptor plate and the contact legs is less than the distance B between adjacent rows of contacts when the two rows of contacts engage the second circuit board. Also, as shown in FIG. 6, the distance A is less than the row spacing distance C by which contacts in the row 24 are spaced apart. In fact, the distance A is preferably no more than the distance or length D of the gap between adjacent contacts 34A, 34B. Even if the distances A and D were equal, there would be closer coupling between each contact leg 46 and an adjacent interceptor plate 60 because the adjacent faces of the plate and leg 46 have greater areas than the adjacent surfaces of the two contacts 34A, 34B.

As shown in FIG. 2, the height H of each interception plate such as 62 is more than half the height G of the adjacent contact leg 58. The connector housing includes an insulator 72 with a location 74 that backs the forward end of the contact leg to limit its deflection away from the region 76 where the second circuit board is received. The interception plate such as 62 extends slightly below this insulator location 74 so that the space 76 between each contact leg and interception plate can be substantially empty. That is, the space 76 is substantially devoid (at least 90% of the space is empty) of solid material including insulation. By providing a substantially empty space between the plate and contact leg, applicant avoids degradation of capacitive coupling that would result from the presence of (solid) material in the space.

Applicant prefers that the height H of the plate be at least about 75% and preferably at least 90% of the height G of the contact leg 58. The fact that the contact legs are substantially coplanar allows the relatively simple interception plate to lie facewise close to the large areas of all contacts of the adjacent row. The interception plates also provide shielding against radio frequency interference although this is a secondary consideration.

As shown in FIG. 4, the interception plates 60, 62 are parts of an interceptor 82 which is formed of a copper alloy for good electrical conduction. Each plate has recesses 83 in its rear edge, through which pass the mounted parts 36 of alternated contacts of a row. The interceptor includes bridges 84, 86 that connect the plates and that are integral with them. The bridges lie facewise adjacent to the upper surface 20*f* (FIG. 1) of the support. The interceptor has pins 90, 92 that pass through holes in the support and that engage plated-through holes in the first circuit board. The pins 90 are connected to a source of controlled potential which is preferably DC such as ground, although it may vary regularly, or periodically. Actually, applicant prefers to connect the pins and therefore all of the interceptor to a source which has a potential at least as low as or lower than the potential on any of the contacts that lie adjacent to either of the plates. Thus, in a computer system wherein the extreme voltages are +12 volts and −12 volts, and the signal pins carry high frequency signals that are between these voltages, applicant prefers to maintain the interceptor and its plates 60, 62 at a potential of no more than −12 volts, (DC or peak-to-peak periodically varying), and preferably below that, such as −15 volts. By maintaining the interceptor plates at a voltage below that of any of the contacts, applicant sets up an appreciable electric field between each contact and the interceptor plate. This electric field influences adjacent magnetic fields so that magnetic fields around any contact carrying a high frequency signal do not extend with appreciable intensity to the vicinity of adjacent contacts, to avoid cross talk. In FIG. 1, the conductor 11A that connects to the interceptor pin 90, is shown as at a voltage below ground.

Figure 8:
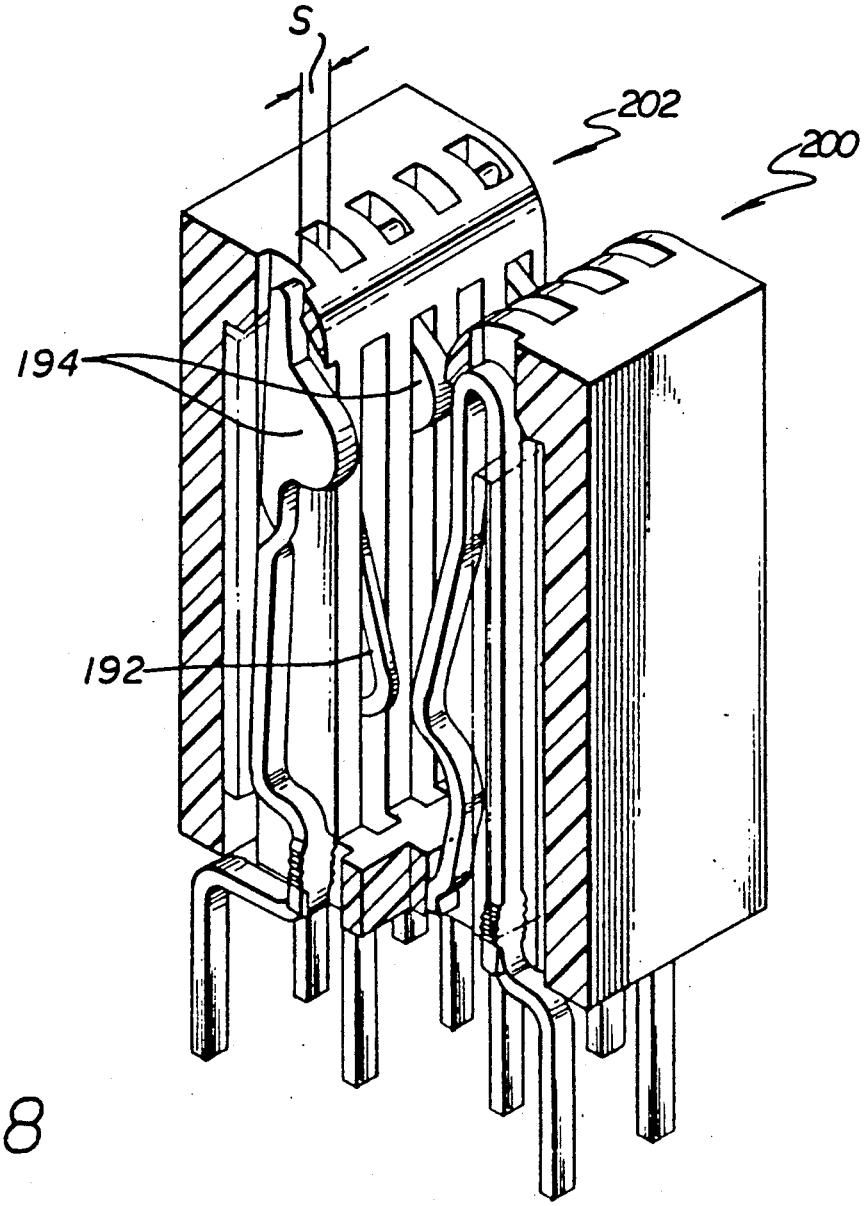
FIG. 8 is a partial perspective view of the connector of FIG. 7.
Figure 7:
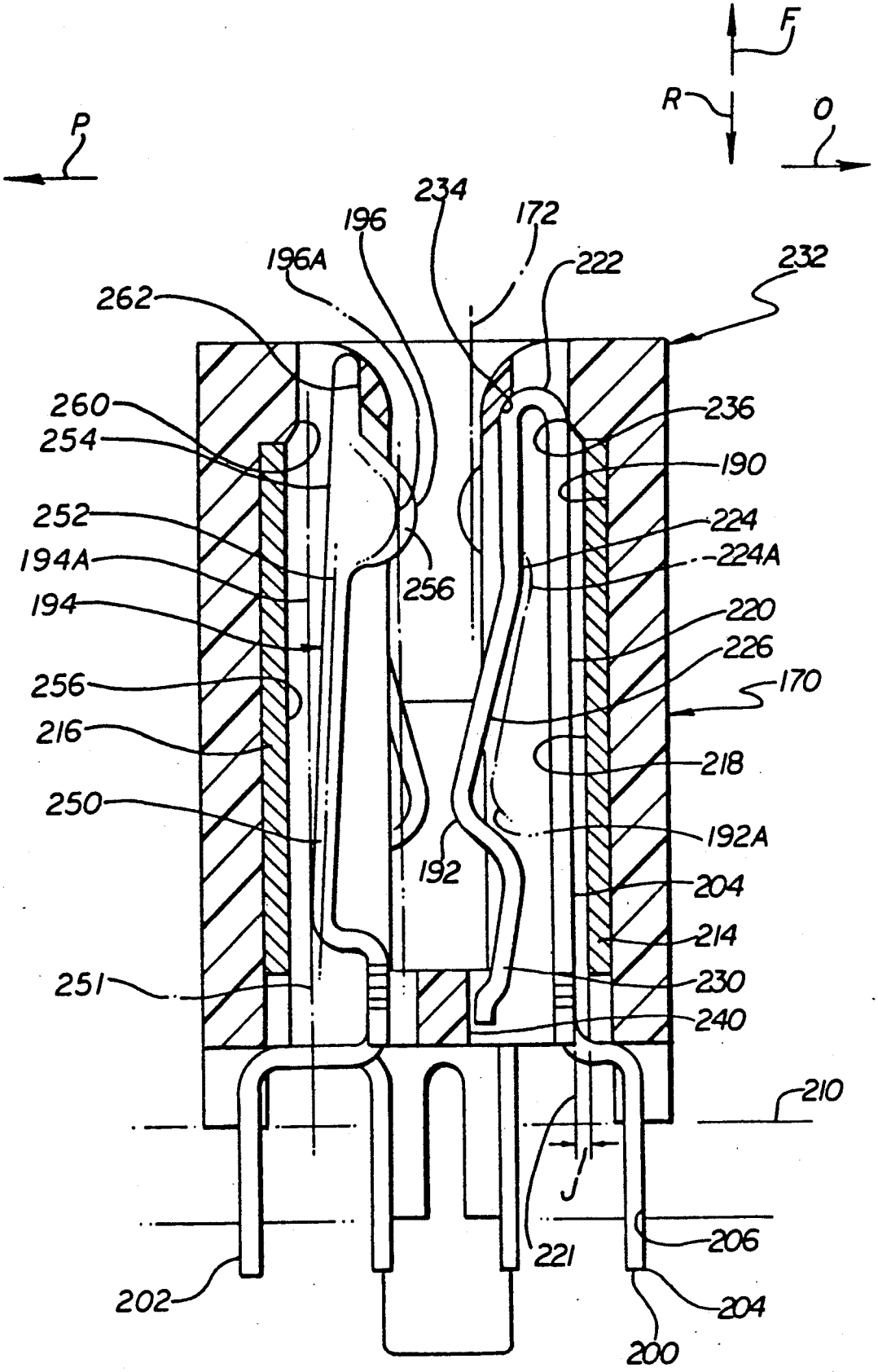
FIG. 7 is a sectional view of a connector constructed in accordance with another embodiment of the invention.
Figure 9:
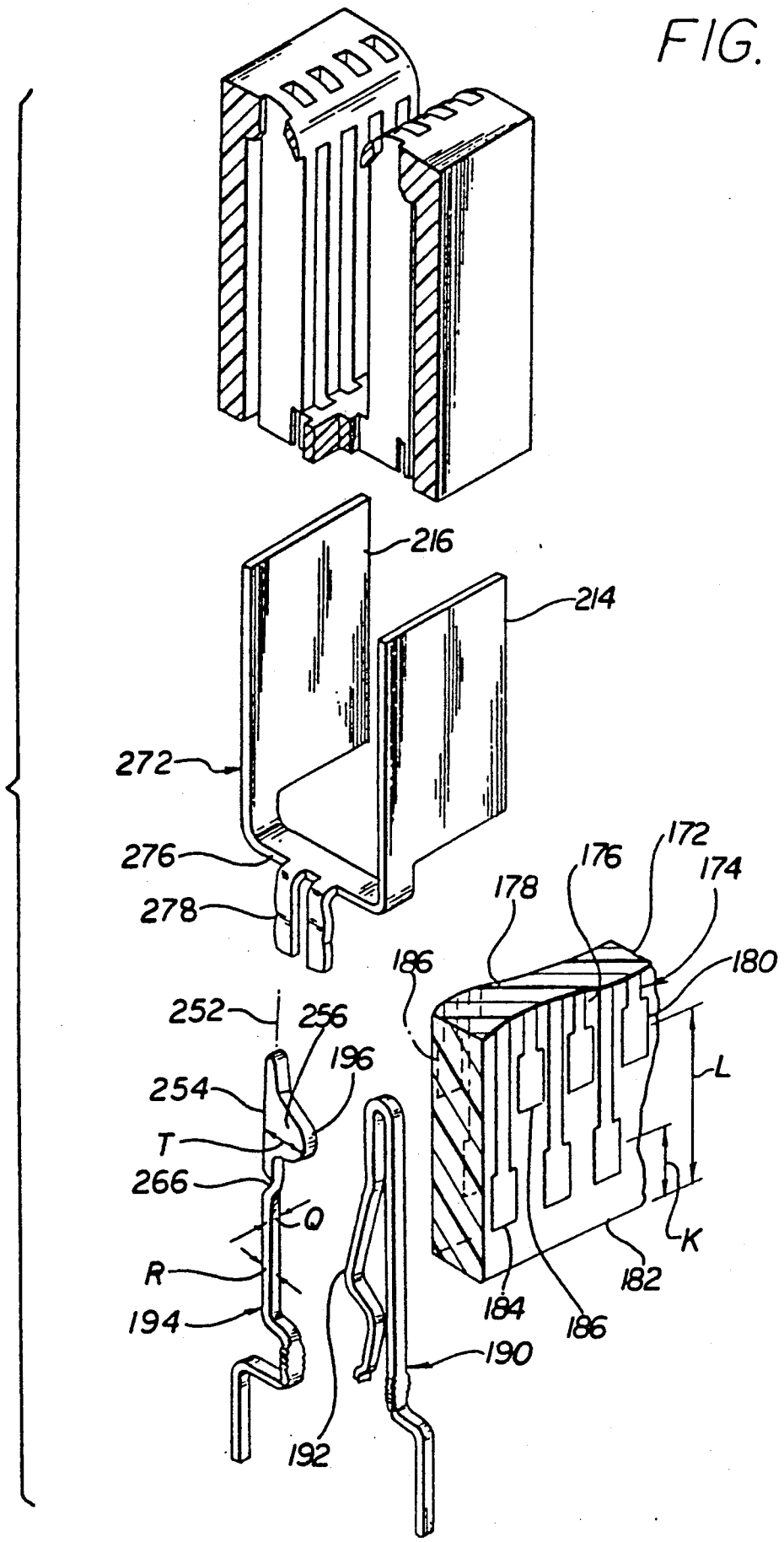
FIG. 9 is a partial exploded view of the connector of FIG. 7.

FIGS. 7–9 illustrate another connector 170 which is a card connector that receives a circuit board card 172 and connects to conductive traces on the card. As shown in FIG. 9, the card 172 has traces 174 on its opposite faces 176, 178, with each trace having a pad 180 where a contact of the connector can engage the trace. The pads on each face of the card alternate in distance from a card leading edge 182, with a first group of pads 184 lying a first distance K from the card leading edge and with a second group of pads 186 lying a greater second distance L from the card leading edge. The connector has two types of contacts, including a first type 190 with a contact location 192 that can lie close to the card leading edge to engage the first pads 184. A second type contact 194 has a contact location 196 which is spaced further from the card leading edge to engage the second pads 186. Both types of contacts are constructed to provide a long bendable contact region to provide considerable resilience.

As shown in FIG. 7, the contacts are arranged in first and second rows 200, 202, with the contacts of each row including a mounted part 204 lying in a hole 206 of a housing insulative support 210, which can lie on a circuit board or which can be a circuit board. A pair of interception plates 214, 216 of electrically conductive material each have an inner face such as 218 lying parallel and close to one of the rows of contacts, with the two rows of contacts lying between the two plates. The contacts are spaced apart to receive the card 172 between them. When the card is received, the contact locations 192, 196 move outwardly to the positions 192A, 196A. It should be noted that each row of contacts has both the first and second types of contacts.

The first type of contact 190 has a leg 220 that extends straight in the forward direction F, in a plane 221 that is parallel to the inner face 218 of the adjacent interception plate 214. The contact has a forward portion 222 extending in a substantially 180° loop away from the adjacent plate, and a reverse arm 224 extending largely rearwardly in the direction R. The reverse arm has a protrusion 226 bent away from the adjacent plate 214 and forming the contact location 192. The reverse arm has a rear end at 230. When a circuit board card is received in the position 172, the reverse arm of the contact bends to the position 224A.

The leg 220 of the contact 190 is closely controlled in position so that it extends parallel to the plate inner face 218, and with a small but controlled spacing J between them. As discussed above, it is desirable that the spacing distance J be as small as possible to provide maximum capacitive coupling between the contact and interception plate, but that the spacing be great enough to avoid direct contact between them. The connector housing includes an upstanding insulator 232 which controls the position of the interception plate 214, and which has inner and outer stops 234, 236. The second or front portion 222 of the contact substantially abuts the two stops to control its position. The abutment of the contact front portion with the outer stop 236 is of greatest importance, in that it prevents direct engagement of the contact with the interception plate, and because the contact will normally be pressed against the outer stop 236 when a card is installed that presses the contact in an outward direction 0 towards an adjacent interception plate 214. The upstanding insulator forms an additional stop 240 that can abut the rear end 230 of the contact to control the position of the rear end. Such control is useful to prevent contacts from touching one another before a card is installed.

The contact 190 provides a long reverse arm 224 that can resiliently deflect to engage a trace on an installed card, and also provides a long leg 220 which lies close to the interception plate to assure good capacitive coupling between them.

The second type contact 194 includes a forwardly projecting leg 250 with most of its length being of uniform width along an imaginary centerline 252. The contact leg also includes a forward portion 254 having an enlargement 256 containing the contact location 196. When the card 172 is installed, and the contact is deflected to the position 194A, the leg 250 lies substantially in a plane 251 close to and parallel to an inner face 256 of the interception plate 216. An outer stop 216 limits outward movement, in the direction P of the second contact towards the interception plate, while an inner stop 262 limits opposite inward movement.

All of the contacts, including the second type 194, are formed by stamping them from a metal sheet. Each contact is formed so it has a greater width Q (FIG. 9) than its thickness R. This enables easier deflection of the contact and also results in a greater area of each contact lying adjacent to a corresponding interception plate. The contacts are formed from a sheet of the thickness R. However, the enlargement 256 has a solid thickness T several times greater than that of the sheet. In order to facilitate manufacture of the second type contact 194, applicant forms the enlargement 256 so it initially extends in the plane of the sheet of metal of thickness R. After the contact is punched out of the sheet, the outer contact portion 254 is twisted 90° about the centerline 252 of the contact at location 266. This results in the enlargement projecting towards the card to hold the contact location 196 adjacent to the card, in a contact of rugged construction.

Referring again to FIG. 7, it can be seen that each of the interception plates extends along more than 75% of the height of each contact leg, and that there is no insulation between each interception plate and an adjacent contact. The outer stops such as 236 and 260 lie above the top of the interception plate.

As shown in FIG. 8, the two types of contacts alternate in each row, so that in the first row 200 the contact types 192 and 194 alternate, and the same occurs along the second row 202. As shown in FIG. 9, the interception plates are part of an interceptor 274 similar to that of FIG. 1, which includes a bridge 276 and a slotted pin 278.

Applicant has designed a connector of the type illustrated in FIG. 7–9, with the distance S (FIG. 8) between adjacent surfaces of contacts of a row being about 20 mil (one mil equals one thousandth inch) and with the distance J (FIG. 7) between a contact leg and an adjacent interception plate in the deflected position of the contact being 10 mil.

Thus, the invention provides a connector with an interception plate which lies along the length of a row of contacts adjacent to the contact legs, where the legs have faces that all lie substantially in a single plane, to isolate each contact from the others to avoid cross talk, especially at high speed operation or high rate switching. The interception plate is at a controlled potential and lies close to a wide area of the contact legs to provide close capacitive coupling of the plate to the contact legs. The plate or selected portions thereof are each preferably of a potential considerably below that of the dc potential on adjacent contacts. In connectors with two rows of contacts, the plates are preferably located so two rows of contacts lie between the two plates, and without substantial insulation between each plate and an adjacent contact leg.

Although particular embodiments of the invention have been described and illustrated herein, it is recognized that modifications and variations may readily occur to those skilled in the art and consequently it is intended to cover such modifications and equivalents.

What is claimed is:

1. A card connector for receiving and connecting to the conductive traces of a circuit board card of predetermined thickness, comprising:

a housing having an insulative support;

first and second rows of resiliently bendable contacts in said housing with the contacts of each row including a mounted part in said support and an elongated leg lying generally forward of said mounted part and having an outer portion, said rows of contacts being spaced apart to receive said card between them and said contacts having contact locations for engaging corresponding traces of said card;

a pair of interception plates of electrically conductive material, each interception plate lying in a plane extending parallel to a said row of contact legs, said interception plates lying on opposite sides of the space between said first and second rows of contacts, and each interception plate being at a predetermined potential, with the space between each interception plate and the contacts of an adjacent row being substantially devoid of insulation;

said contacts being deflectable to a deflected position toward a corresponding one of said interception plates by a card, and said housing including a plurality of stops that are each positioned to abut the outer portion of a contact leg to limit its movement toward a corresponding interception plate;

said contact legs extending parallel to one of said interception plates in the deflected position of said contacts, and each interception plate lying closer to the contacts of an adjacent said row of contacts in the deflected positions of the contacts, than the distance between said contacts in said adjacent row.

2. The card connector described in claim 1 wherein:

each of said stops lies forward of the space between said interception plate and a corresponding one of said contacts.

3. The card connector described in claim 1 wherein:

a plurality of said contacts each includes said leg which extends straight in a forward direction, parallel to an adjacent interception plate, a forward end extending in a substantially 180° loop, and a reverse arm extending largely rearwardly with a protrusion bent away from an adjacent interception plate and forming one of said contact locations and with said reverse arm having a rear end, said support forming a second stop which abuts said rear end to limit its movement away from said adjacent interceptor plate.

4. The card connector described in claim 1 wherein:

a plurality of said contact legs are each formed from a metal sheet, with most of each contact leg being of uniform width along an imaginary centerline of the leg, but with each contact leg including a forward portion having an enlargement containing said contact location with the enlargement being of greater width than the rest of the contact leg, and with said forward portion being twisted 90° about said centerline.

5. The connector described in claim 1 wherein:

said pair of interception plates comprise portions of an interceptor that includes a bridge connecting said plates and integral with them, said bridge having a mounted part projecting into a hole in said support.

6. A card connector for receiving and connecting to the conductive pads of traces of a circuit board card of predetermined thickness which has traces on its opposite faces and which has a leading edge, comprising:

a housing which includes a support of insulative material;

first and second rows of contacts with rearward portions held in said support and with said rows of contacts being spaced apart to receive said card between them, and each of said contacts having a contact location where it engages one of said traces on said card;

a pair of electrically conductive interception plates each lying in a plane extending parallel to an imaginary row of said contact legs, said pair of plates lying on opposite sides of the space between said first and second rows of contacts, said plates each having a predetermined potential, and the space between each contact and an adjacent said plate being substantially devoid of insulation;

a first plurality of said contacts each having a leg extending forwardly, a forward end extending in a 180° loop away from an adjacent plate, and a reverse arm extending in a generally rearward direction from said forward end, each of said reverse arm having a protrusion bent toward the other row of contacts and having said contact location, said legs extending parallel to an adjacent interception plate, and the space between each of said legs and said adjacent plate being less than the distance between adjacent contacts in a said row.

7. The card connector described in claim 6 wherein:

the pads on each face of said card alternate in distance from said card leading edge, with a first group of pads spaced a first distance from said edge and a second group of pads spaced a larger second distance from said edge;

a second plurality of said contacts are each formed of a metal sheet with a contact leg extending forwardly and having a greater first width in a direction along the corresponding row than its thickness perpendicular to the row, each contact leg having an outer portion with a region of greater thickness than said first width but said outer portion twisted by 90° about the length of said first portion and with said region having said contact location, said region located so said contact location can engage a pad at said second distance from said card edge.

8. A connector for connecting first and second circuit boards lying in perpendicular planes, comprising:

an insulative housing forming a support lying on said first circuit board and forming a space for receiving the second board at a final position;

first and second rows of contacts lying on opposite sides of said second board final position, each contact having a mounted part mounted in said support and in the first circuit board, and each contact having a strip-shaped leg extending in a forward direction away from said support, the legs of the contacts in each row being spaced apart along the row and the legs of the contacts in said first and second rows having outer faces furthest from said second board final position, and the outer leg faces of the contacts in said first and second rows lying respectively in first and second imaginary planes;

first and second interception plates, each having a predetermined potential, said plates having inner faces facing said contact leg outer faces, said plate inner faces lying in planes that are parallel respectively to said first and second planes;

the inner face of each interception plate lying a distance from corresponding contact leg outer faces which is less than the spacing of said legs along the row, and each plate extending along most of the height of the corresponding contact legs;

the space between the contacts of each row and an adjacent interception plate being substantially devoid of insulation, and said housing forming a stop that abuts a forward location of each contact leg to limit its movement toward a corresponding interception plate to a contact position wherein the contact leg extends parallel to the corresponding plate.

9. The connector described in claim 8 wherein:

said first and second interception plates are parts of an interceptor that includes a pair of bridges lying against said support and connecting said plates, said interceptor including at least one pin extending through said support into said first circuit board.

10. A connector comprising:

insulative support means;

a row of contacts with each contact including a mounted part in said support means and an elongated leg extending primarily in a predetermined forward direction from said mounted part, with the legs of the contacts in said row lying substantially in an imaginary plane;

an interception plate of electrically conductive material lying in a plane extending parallel to said imaginary plane of said row, said interception plate lying closer to the contacts of said row of contacts than the distance between said contacts in said row, and said interception plate having at least a portion adjacent to a plurality of said contacts and at a predetermined potential; and the space between each said contact leg and said adjacent interception plate being substantially devoid of insulation.

11. The connector described in claim 10, wherein:

said legs of said plurality of said contacts are deflectable toward said interception plate; and stop means is provided on said support means positioned to prevent engagement of said interception plate by said legs.

12. The connector described in claim 10 wherein:

said legs of said plurality of said contacts each has a rearward portion extending from its mounted part and a forward portion spaced forwardly from said rearward portion, and each of said legs of said plurality of contacts is bendable and most of its length initially lies angled from parallelism with said interception plate with its forward portion further from said plate than its rearward portion, and said support includes stop means positioned to abut the forward portiion of each said leg to limit its movement toward said plate past a location where the leg lies substantially parallel to the plate.

* * * * *